US008348207B2

(12) United States Patent
Wang et al.

(10) Patent No.: US 8,348,207 B2
(45) Date of Patent: Jan. 8, 2013

(54) FOLDABLE SUPPORTING DEVICE

(76) Inventors: Chen-Chung Wang, Taipei (TW); Kenneth Wang, Taipei (TW)

( * ) Notice: Subject to any disclaimer, the term of this patent is extended or adjusted under 35 U.S.C. 154(b) by 0 days.

(21) Appl. No.: 12/393,696

(22) Filed: Feb. 26, 2009

(65) Prior Publication Data

US 2009/0218466 A1 Sep. 3, 2009

(30) Foreign Application Priority Data

Feb. 29, 2008 (CN) ..... 2008 1 0008010

(51) Int. Cl.
*F16M 11/38* (2006.01)

(52) U.S. Cl. ..... 248/188.6; 248/346.3; 5/175

(58) Field of Classification Search ..... 248/166, 248/188.6, 346.01, 346.07, 346.3, 440.1; 5/174, 175, 111
See application file for complete search history.

(56) References Cited

U.S. PATENT DOCUMENTS 608,442 A * 8/1898 Cronmiller ..... 248/166
3,381,923 A * 5/1968 Berry ..... 248/166
3,881,202 A * 5/1975 Tyhanic ..... 5/176.1
6,499,705 B1 * 12/2002 Tsai ..... 248/167
6,581,223 B1 * 6/2003 Wang ..... 5/174
7,377,504 B2 * 5/2008 Houldsworth ..... 269/296
7,739,760 B2 * 6/2010 Wang et al. ..... 5/176.1
7,740,108 B2 * 6/2010 Adkins ..... 182/153
2004/0000009 A1 * 1/2004 Choi ..... 5/174
2004/0084581 A1 * 5/2004 Chang ..... 248/166
2010/0181459 A1 * 7/2010 Wang et al. ..... 248/419

* cited by examiner

*Primary Examiner* — Bradley Duckworth

(74) *Attorney, Agent, or Firm* — DLA Piper LLP (US)

(57) ABSTRACT

A foldable supporting device includes parallel supporting frames and foldable units, each of which interconnects an adjacent pair of the supporting frames and includes a pair of crossing members that cross and that are pivoted to each other, and a joint mechanism having a pair of first joints and a pair of second joints that are connected respectively to the adjacent pair of the supporting frames. Each of the crossing members interconnects a respective one of two diagonally aligned pairs of the first and second joints. At least one of the pair of the first joints and the pair of the second joints interconnect upper and lower parts of the adjacent pair of the supporting frames, respectively.

12 Claims, 20 Drawing Sheets

FOLDABLE SUPPORTING DEVICE

CROSS-REFERENCE TO RELATED APPLICATION

This application claims priority of Chinese application no. 200810008010.4, filed on Feb. 29, 2008.

BACKGROUND OF THE INVENTION

1. Field of the Invention

The invention relates to a foldable supporting device, more particularly to a foldable supporting device including supporting frames aligned in a direction and foldable units interconnecting the supporting frames and foldable in the direction.

2. Description of the Related Art

Referring to FIG. 1, U.S. Pat. No. 6,581,223 discloses a conventional foldable frame assembly that includes a plurality of supporting frames 7 aligned in a folding direction, and a plurality of foldable units 8, each of which is disposed between and interconnects an adjacent pair of the supporting frames 7, each of which is foldable in the folding direction, and each of which includes a pair of crossing rods 81, a pair of first linking rods 82, a pair of second linking rods 83, a middle beam 84, a pair of upper joints 85 and a pair of lower joints 86. Each of the supporting frames 7 has a pair of pillars 71 and upper and lower beams 72. The upper and lower beams 72 interconnect upper and lower ends of the pillars 71 through a pair of upper connectors and a pair of lower connectors 73. A pair of first joints 91 are respectively fixed to an aligned pair of the lower connectors 73, that are aligned in the folding direction, on each adjacent pair of the supporting frames 7. A pair of second joints 92 are mounted slidably and respectively on the lower beams 72 of each adjacent pair of the supporting frames 7. The crossing rods 81 of each of the foldable units 8 cross each other, are pivoted respectively to the first joints 91 on the adjacent pair of the supporting frames 7, and are further pivoted respectively to the second joints 92 on the adjacent pair of the supporting frames 7. The first linking rods 82 of each of the foldable units 8 are pivoted to each other through a respective one of the lower joints 86, and are further pivoted to the upper connectors on the adjacent pair of the supporting frames 7. The second linking rods 83 of each of the foldable units 8 are pivoted to each other through a respective one of the upper joints 85, are further pivoted to the lower connectors 73 on the adjacent pair of the supporting frames 7, and cross respectively the first linking rods 82. The middle beam 84 interconnects the lower joints 86. In use, the conventional foldable frame assembly is extended to a fully-extended position so as to support a mattress 4 thereon.

The conventional foldable frame assembly is disadvantageous in that each of the foldable units 8 requires too many parts, i.e., the crossing rods 81, the first and second linking rods 82, 83, the upper and lower joints 85, 86, and the middle beam 84, for providing sufficient supporting strength and stability for the foldable frame assembly, which results in an increase in assembly time and manufacturing costs.

SUMMARY OF THE INVENTION

Therefore, the object of the present invention is to provide a foldable supporting device that can overcome the aforesaid drawback associated with the prior art.

According to the present invention, there is provided a foldable supporting device that comprises: a plurality of parallel supporting frames that are aligned with each other in a first direction, each of the supporting frames including upper and lower parts that are opposite to each other in a vertical direction transverse to the first direction; and at least one foldable unit disposed between and interconnecting an adjacent pair of the supporting frames, and foldable in the first direction from an extended position to a folded position so as to vary the distance between the adjacent pair of the supporting frames. The foldable unit cooperates with the adjacent pair of the supporting frames to define a foldable assembly. The foldable unit includes a pair of crossing members that cross and that are pivoted to each other at an intersection thereof so as to be rotatable relative to each other about a first axis, and a joint mechanism having a pair of first joints that are connected respectively to the adjacent pair of the supporting frames and that are aligned in the first direction, and a pair of second joints that are connected respectively to the adjacent pair of the supporting frames, that are aligned in the first direction, and that are respectively aligned with the first joints in a second direction transverse to the first direction. At least one of the pair of the first joints and the pair of the second joints are pivoted to the adjacent pair of the supporting frames so as to be respectively rotatable relative to the adjacent pair of the supporting frames about two second axes. Each of the crossing members extends in a transverse direction relative to the vertical direction and interconnects a respective one of two diagonally aligned pairs of the first and second joints.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
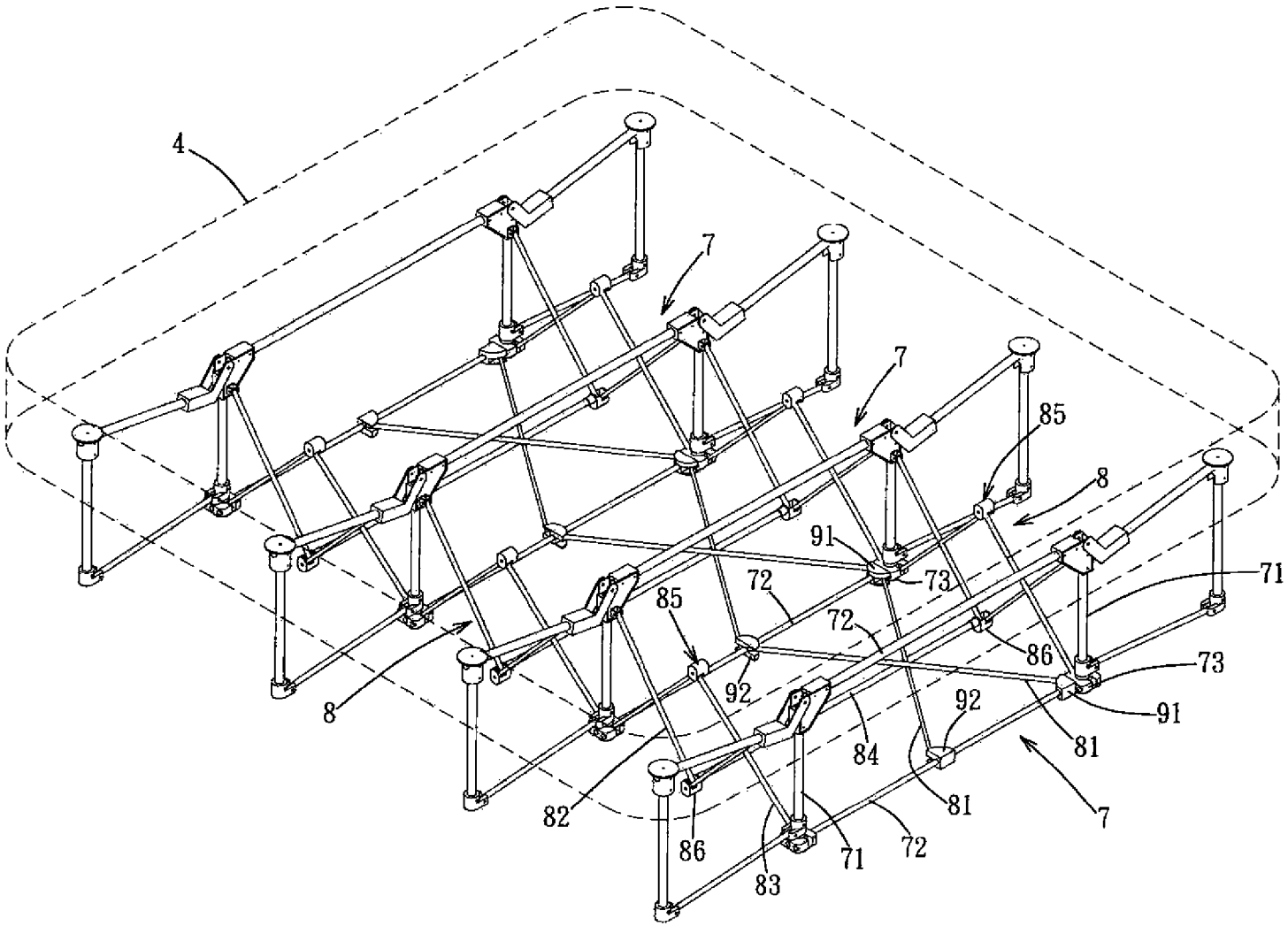
FIG. 1 PRIOR ART
FIG. 1 is an assembled perspective view of a conventional foldable frame assembly disposed at an extended position.

Before the present invention is described in greater detail with reference to the accompanying preferred embodiments, it should be noted herein that like elements are denoted by the same reference numerals throughout the disclosure.

Figure 2:
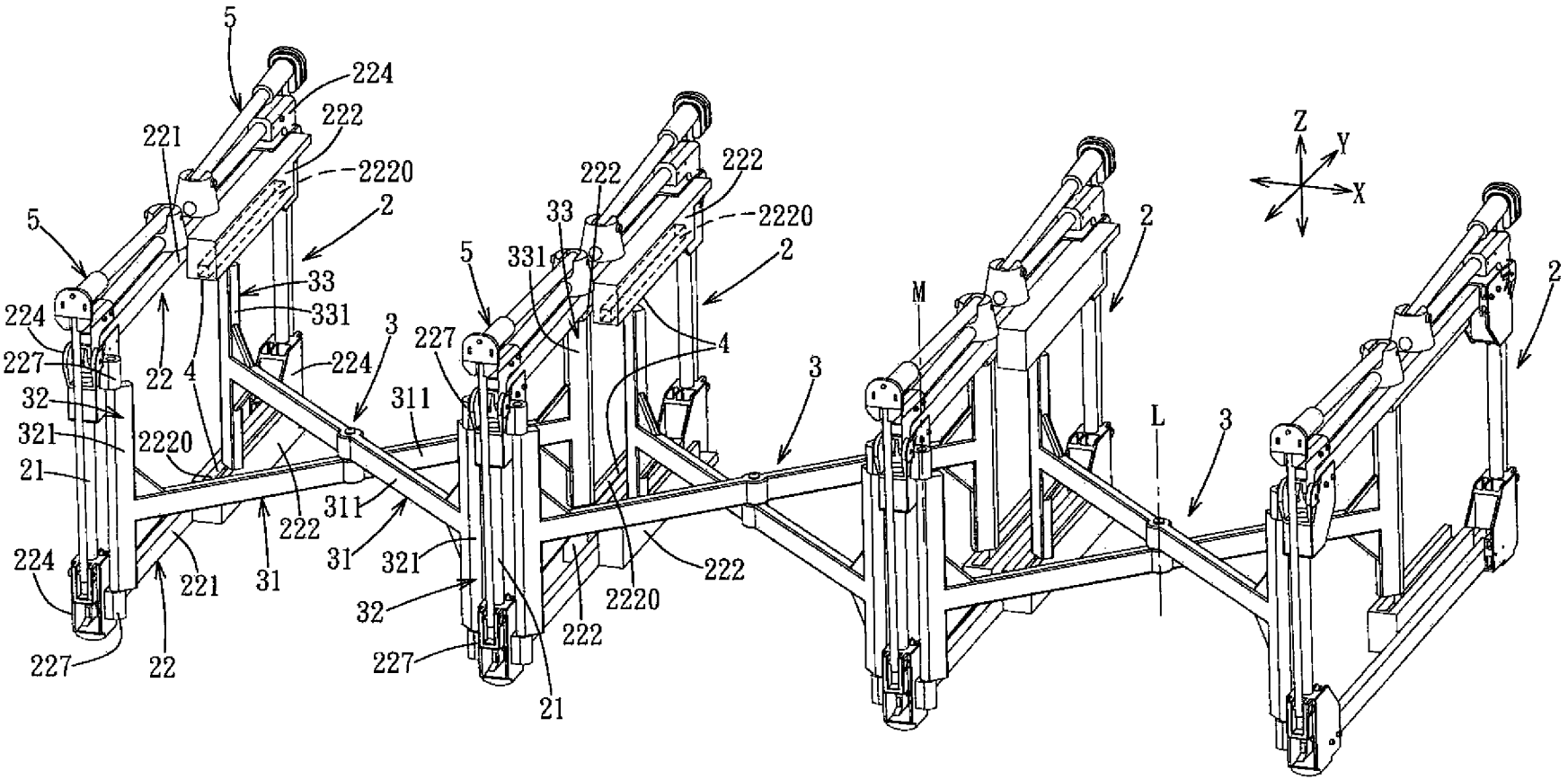
FIG. 2 is an assembled perspective view of the first preferred embodiment of a foldable supporting device according to the present invention, illustrating a state where foldable units are disposed at fully-extended positions.
Figure 3:
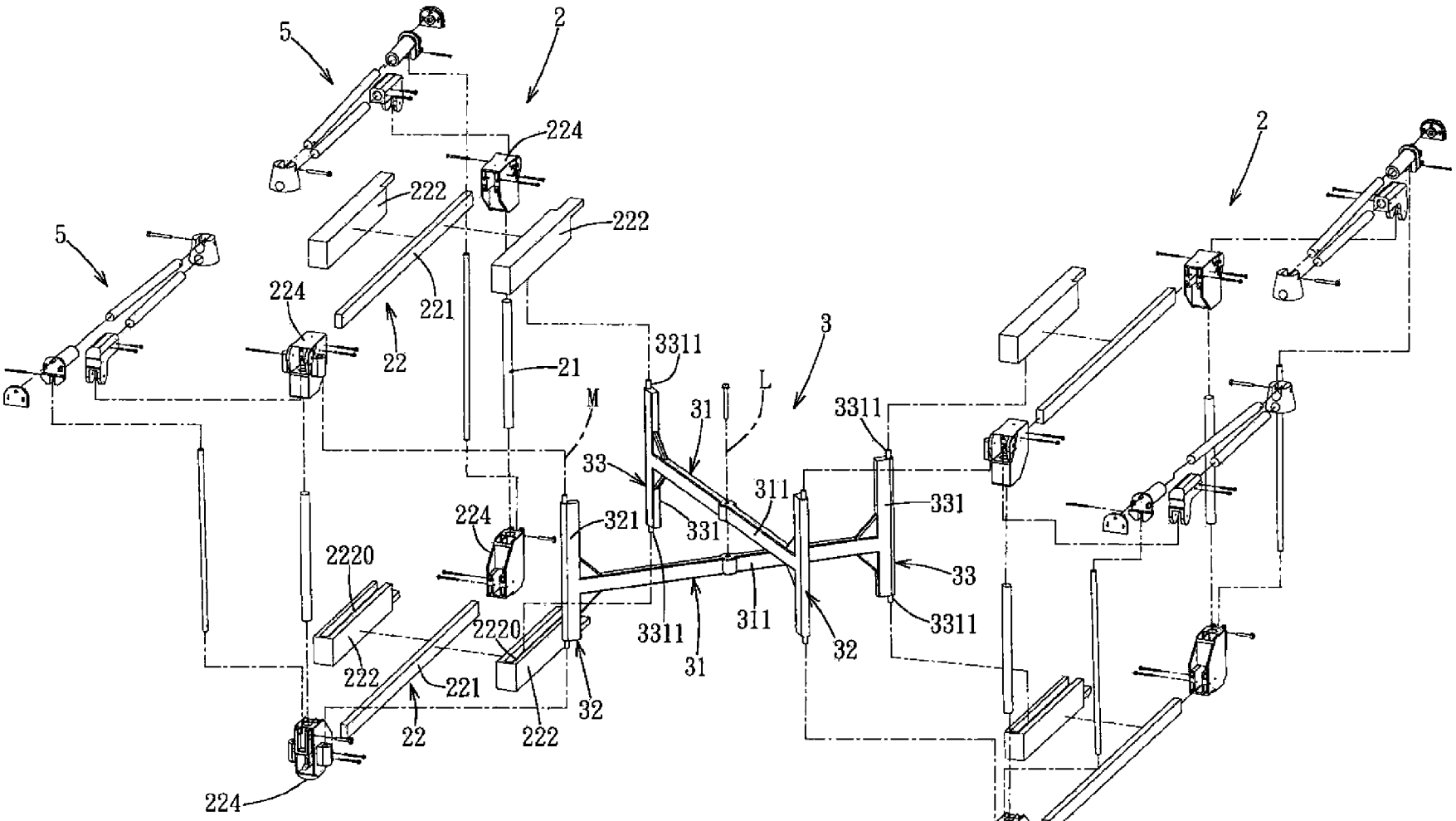
FIG. 3 is an exploded perspective view of a foldable assembly of the first preferred embodiment.
Figure 4:
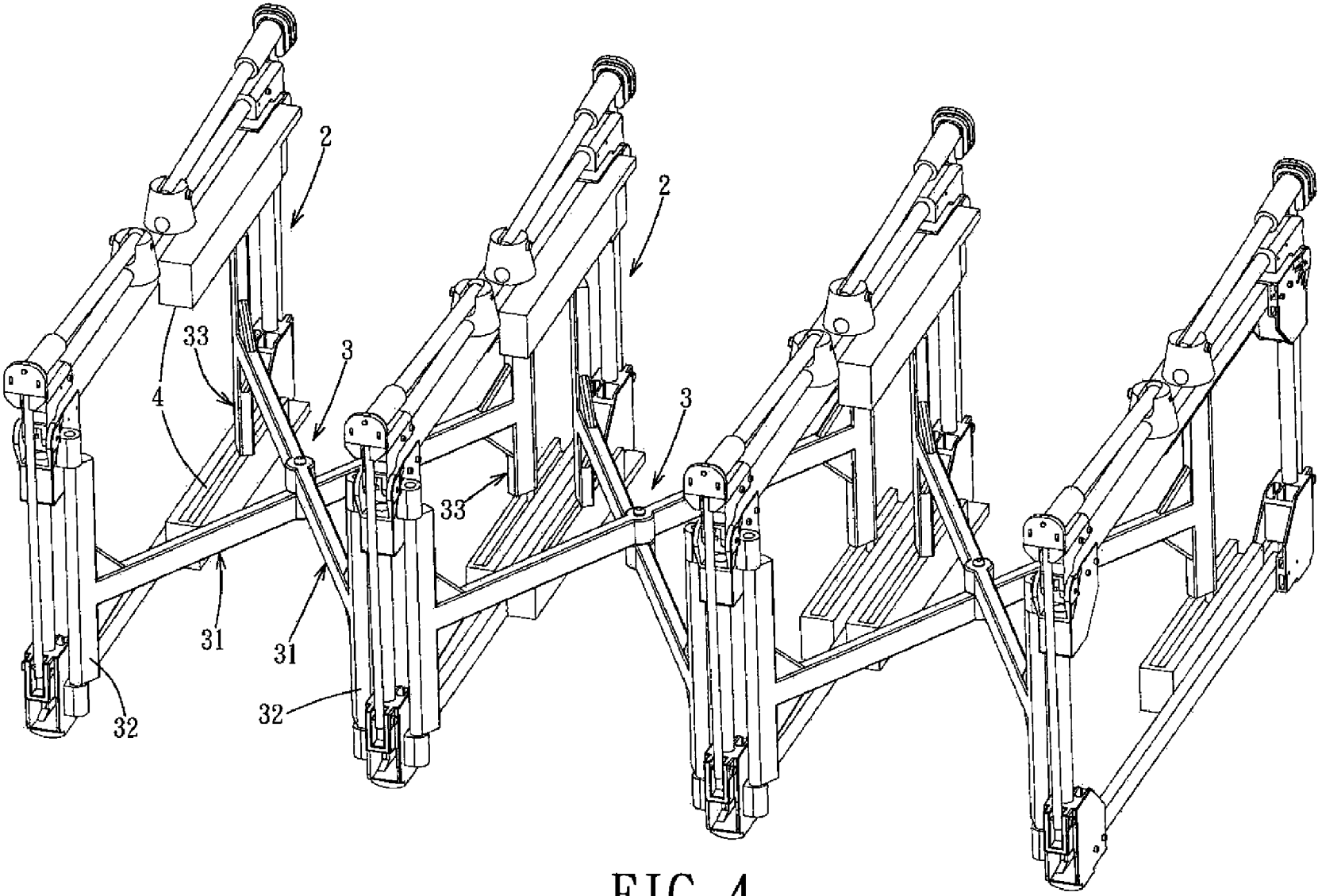
FIG. 4 is an assembled perspective view of the first preferred embodiment, illustrating a state where the foldable units are disposed at semi-folded positions.
Figure 6:
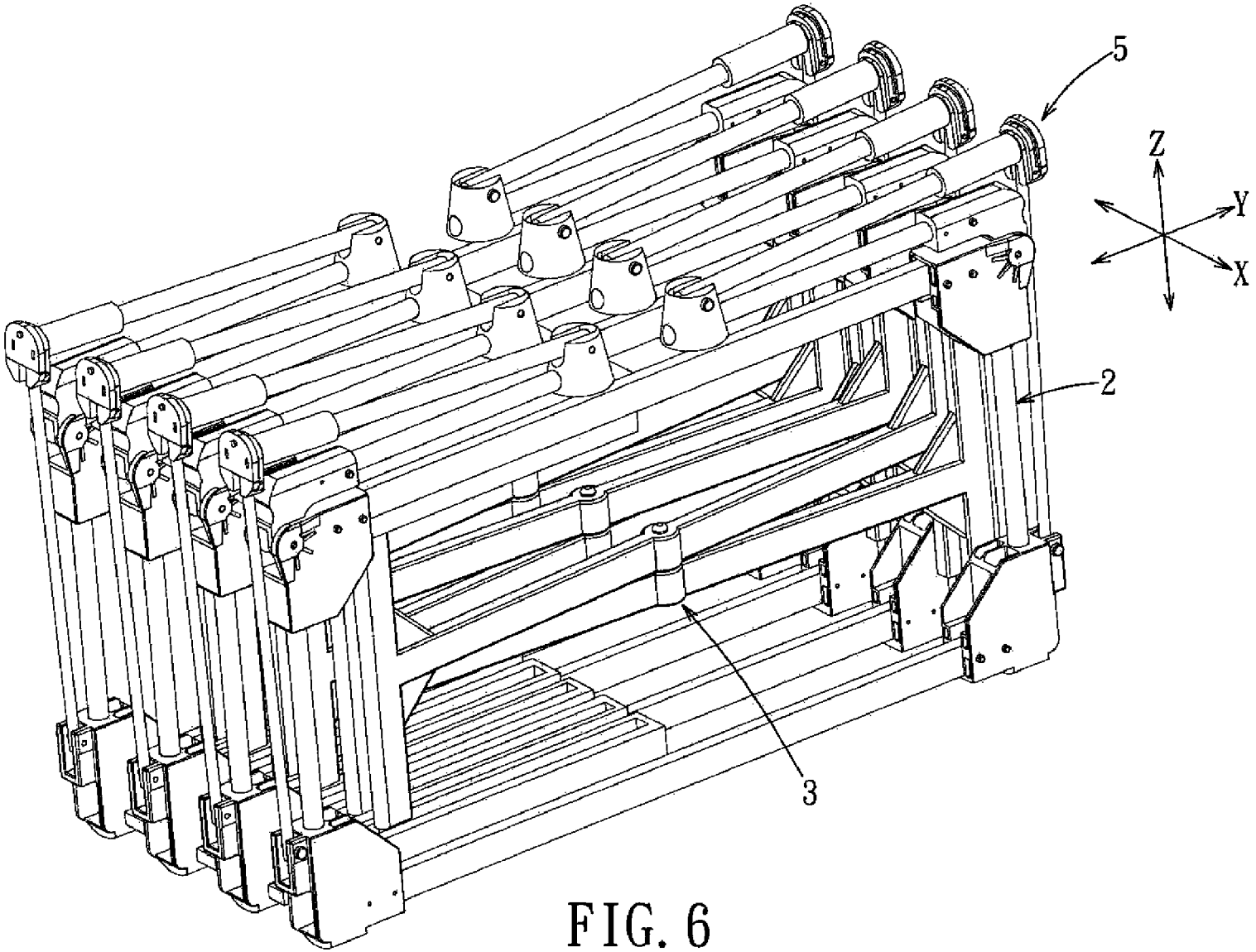
FIG. 6 is a perspective view of the first preferred embodiment, illustrating a state where that foldable units and the auxiliary supporting members are disposed at folded positions.

Referring to FIGS. 2 and 3, the first preferred embodiment of a foldable supporting device according to the present invention is shown to include: a plurality of parallel supporting frames 2 that are aligned with each other in a first direction (X), each of the supporting frames 2 including upper and lower parts 22 that are opposite to each other in a vertical direction (Z) transverse to the first direction (X); and a plurality of foldable units 3, each of which is disposed between and interconnects an adjacent pair of the supporting frames 2, and each of which is foldable in the first direction (X) from a fully-extended position (see FIG. 2) to a fully-folded position (see FIG. 6) so as to vary the distance between the adjacent pair of the supporting frames 2. FIG. 4 illustrates a state of the foldable supporting device where the foldable units 3 are disposed at semi-folded positions (see FIG. 4) between the fully-extended positions and the fully-folded positions. Each of the foldable units 3 cooperates with the adjacent pair of the supporting frames 2 to define a foldable assembly. Each of the foldable units 3 includes a pair of crossing members 31 that cross and that are pivoted to each other at an intersection thereof so as to be rotatable relative to each other about a first axis (L), and a joint mechanism having a pair of first joints 32 that are connected respectively to the adjacent pair of the supporting frames 2 and that are aligned in the first direction (X), and a pair of second joints 33 that are connected respectively to the adjacent pair of the supporting frames 2, that are aligned in the first direction (X), and that are respectively aligned with the first joints 32 in a second direction (Y) transverse to the first direction (X) and the vertical direction (Z). Each of the crossing members 31 extends in a transverse direction relative to the vertical direction (Z), and interconnects a respective one of two diagonally aligned pairs of the first and second joints 32, 33. In this embodiment, the adjacent pair of the supporting frames 2 of the foldable assembly defines a pair of tracks 4 that extend in the transverse direction (note that in other embodiments, it is the joint mechanism of the foldable assembly that defines the tracks 4, (an example of these is described in the following paragraphs in the fifth preferred embodiment). In this embodiment, the pair of the first joints 32 are pivoted respectively to the adjacent pair of the supporting frames 2 of the foldable assembly so as to be respectively rotatable relative to the adjacent pair of the supporting frames 2 about two second axes (M) parallel to the first axis (L), and the pair of the second joints 33 are slidable respectively on the tracks 4 of the adjacent pair of the supporting frames 2. At least one of the pair of the first joints 32 and the pair of the second joints 33 interconnect the upper and lower parts 22 of the adjacent pair of the supporting frames 2, respectively. In this embodiment, both the pair of the first joints 32 and the pair of the second joints 33 interconnect the upper and lower parts 22 of the adjacent pair of the supporting frames 2.

Since the structures of the foldable assemblies are the same, only one foldable assembly is discussed hereinafter for the following preferred embodiments for the sake of brevity unless there is a difference between two adjacent ones of the foldable assemblies.

Each of the supporting frames 2 has first and second sides that are opposite to each other in the second direction (Y), and further includes first and second pillars 21 that are disposed at the first and second sides, respectively, that extend in the vertical direction (Z), and that have upper and lower ends. The upper and lower parts 22 extend in the second direction (Y) and interconnect the upper and lower ends of the first and second pillars 21.

In this embodiment, the upper and lower parts 22 of each of the supporting frames 2 of the foldable assembly cooperatively define a respective one of the tracks 4. The first joints 32 are respectively pivoted to the supporting frames 2. Each of the second joints 33 includes a post 331 extending in the vertical direction (Z), interconnecting slidably the upper and lower parts 22, and slidable on a respective one of the tracks 4. Each of the crossing members 31 is connected to the post 331 of a respective one of the second joints 33.

Each of the upper and lower parts 22 of each of the supporting frames 2 of the foldable assembly has a frame beam 221 extending in the second direction (Y), and a track-defining wall 222 connected to the frame beam 221 and formed with a rail groove 2220 parallel to the frame beam 221. The track-defining walls 222 of the upper and lower parts 22 of each of the supporting frames 2 of the foldable assembly cooperatively define a respective one of the tracks 4. The post 331 of each of the second joints 33 has two opposite end studs 3311 extending respectively into the rail grooves 2220 in the track-defining walls 222 of the upper and lower parts 22 of a respective one of the supporting frames 2 of the foldable assembly.

Each of the upper and lower parts 22 of each of the supporting frames 2 of the foldable assembly further has a pair of corner connectors 224. The frame beams 221 of the upper and lower parts 22 interconnect the first and second pillars 21 through the corner connectors 224 of the upper and lower parts 22. Each of the first joints 32 includes a pole 321 extending between and pivoted to upper and lower knuckles 227 on a vertically aligned pair of the corner connectors 224 of the upper and lower parts 22. Each of the crossing members 31 is connected to the pole 321 of a respective one of the first joints 32.

Each of the crossing members 31 includes a crossbar 311 connected to the respective one of the two diagonally aligned pairs of the first and second joints 32, 33. The crossing members 31 of each of the foldable units 3 are disposed substantially at a middle level between the upper and lower ends of each of the first and second pillars 21 of each of the supporting frames 2.

Figure 5:
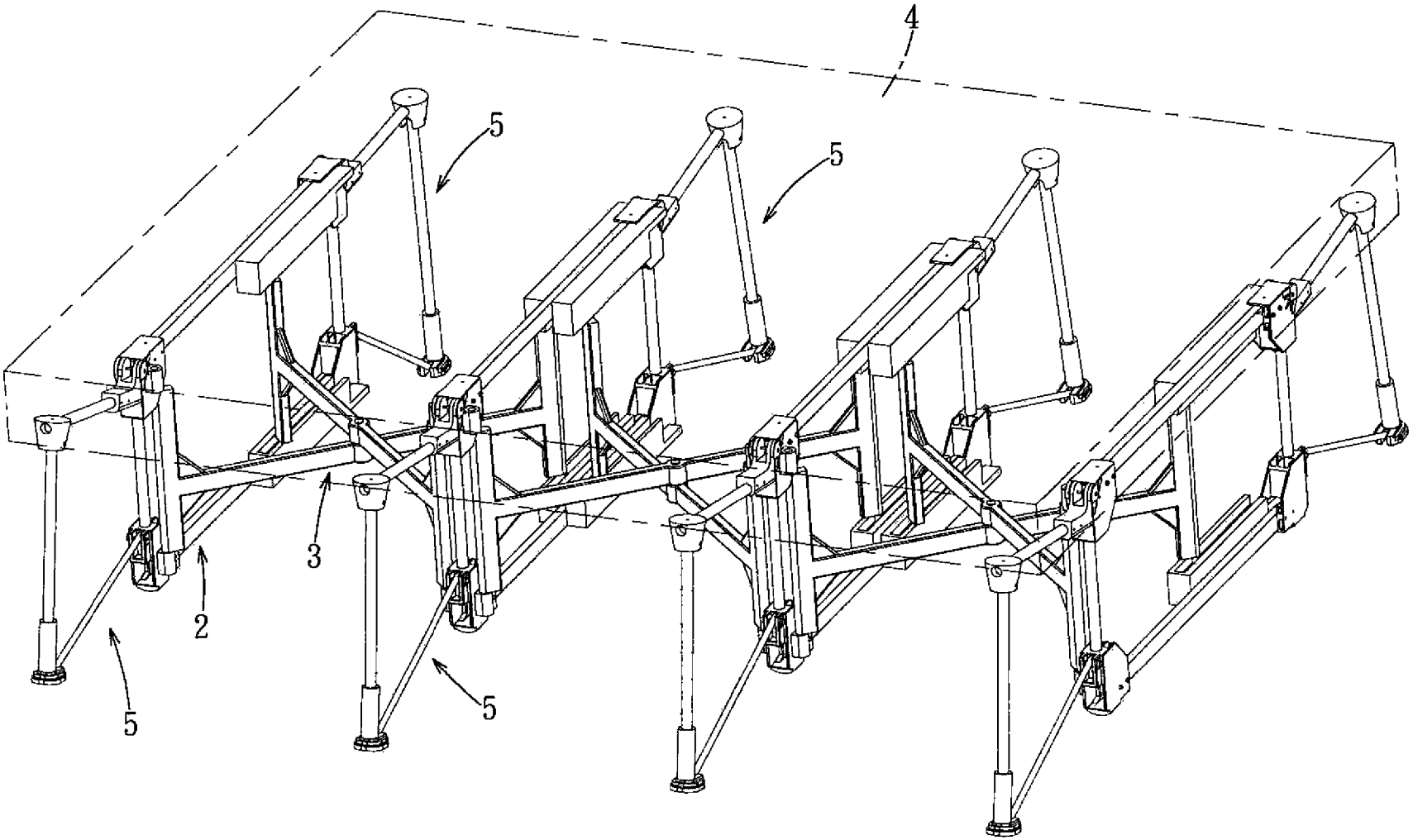
FIG. 5 is a perspective view of the first the preferred embodiment, illustrating a state where the foldable units are disposed at fully-extended positions and auxiliary supporting members are disposed at extended positions for supporting a mattress thereon.

Referring to FIGS. 2, 3 and 5, each of the foldable assemblies defined by the supporting frames 2 and the foldable units 3 is provided with first and second auxiliary supporting members 5 disposed respectively at the first and second sides of a respective one of the supporting frames 2 and pivoted respectively to a vertically aligned pair of the corner connectors 224 on the respective one of the supporting frames 2. Each of the first and second auxiliary supporting members 5 is extendable and foldable in the second direction (Y) so as to permit an increase and a reduction in the length of the foldable supporting device in the second direction (Y). FIG. 5 illustrates a state of the foldable supporting device where the first and second auxiliary supporting members 5 are disposed at extended positions so as to permit the foldable supporting device to support a large mattress 4 thereon. FIG. 2 illustrates another state of the foldable supporting device where the first and second auxiliary supporting members 5 are disposed at folded positions.

Figure 7:
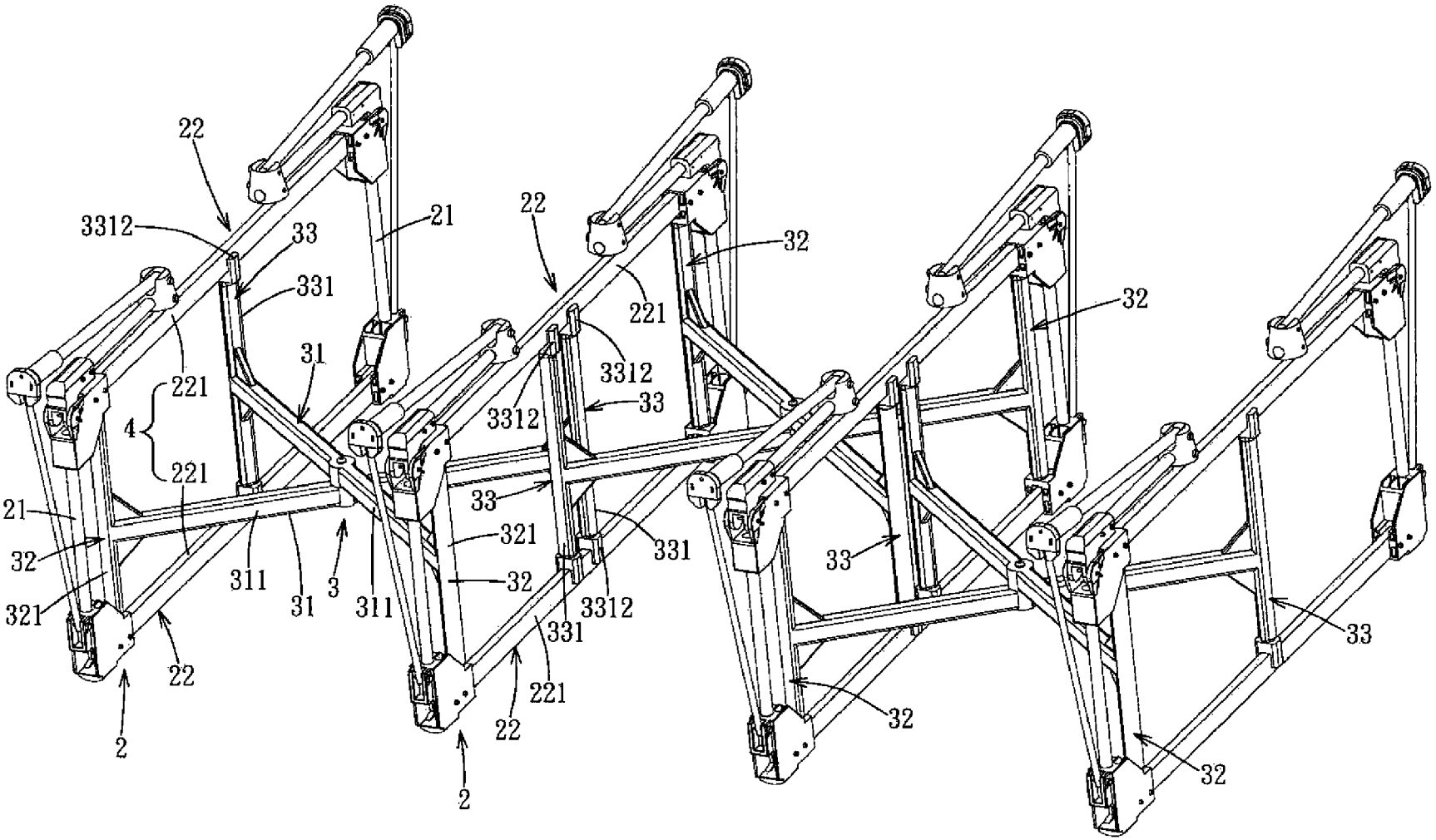
FIG. 7 is an assembled perspective view of the second preferred embodiment of a foldable supporting device according to the present invention, illustrating a state where the foldable units are disposed at fully-extended positions.
Figure 8:
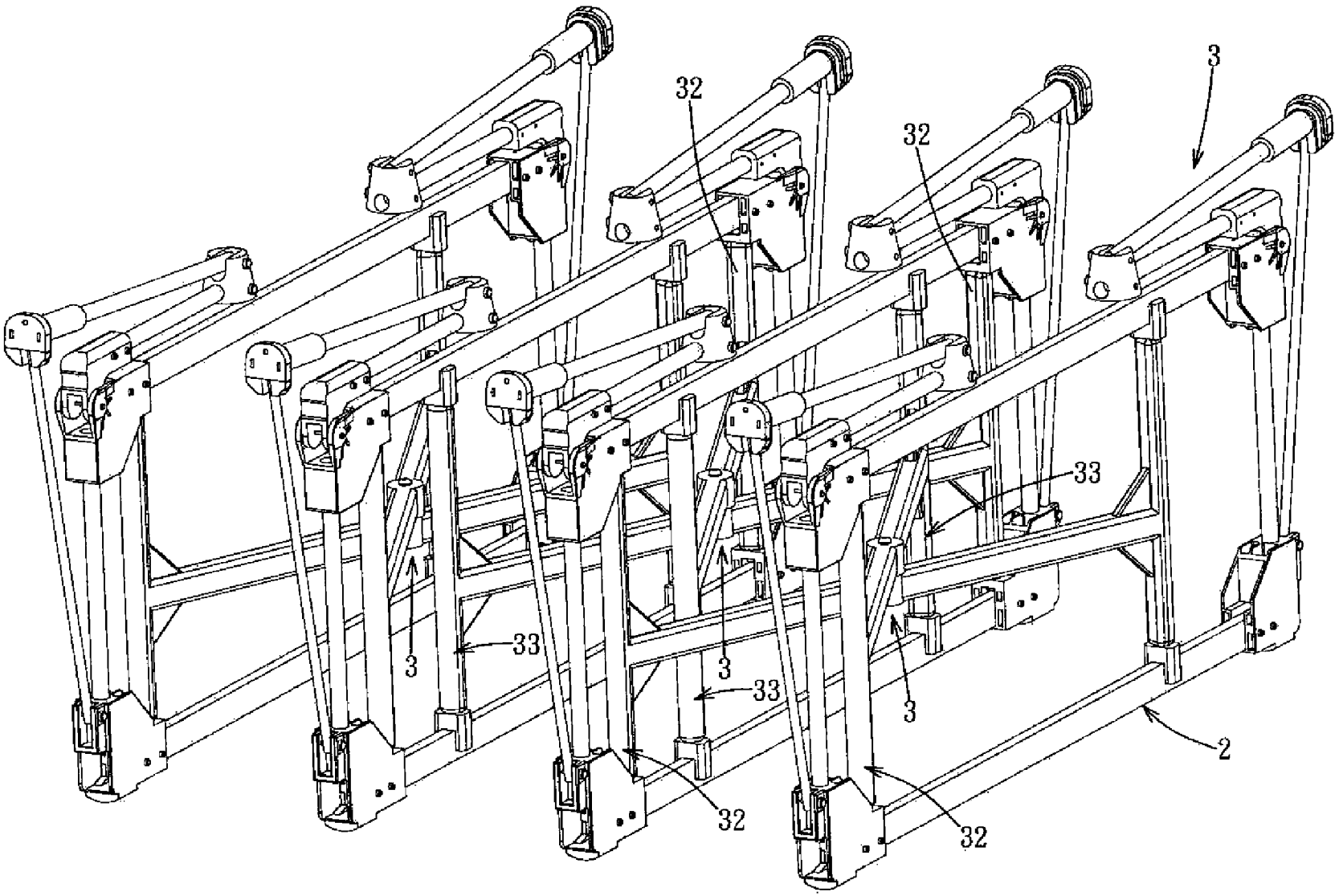
FIG. 8 is a perspective view of the second preferred embodiment, illustrating a state where the foldable units are disposed at semi-folded positions.
Figure 9:
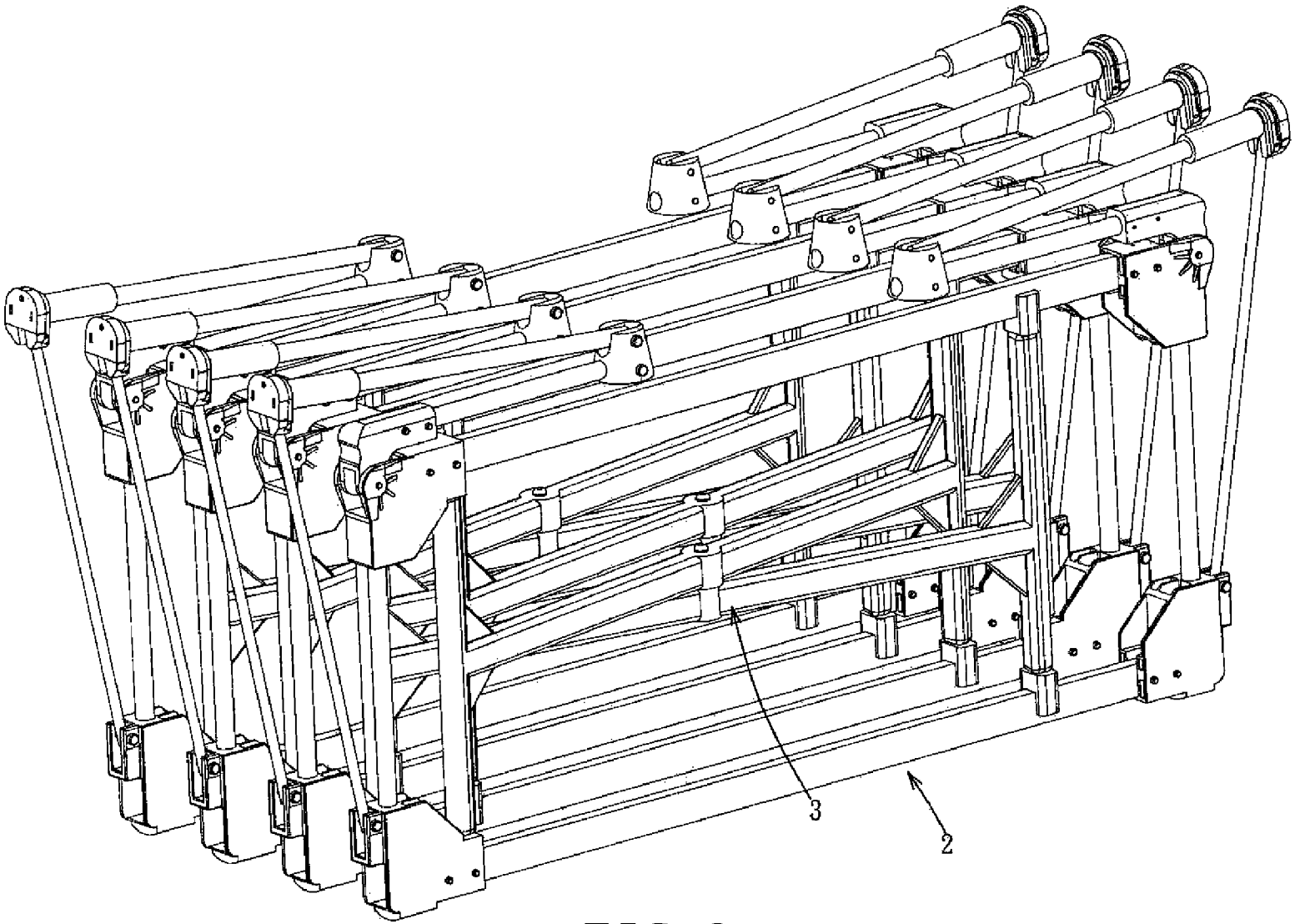
FIG. 9 is a perspective view of the second preferred embodiment, illustrating a state where the foldable units are disposed at folded positions.

FIGS. 7 to 9 illustrate the second preferred embodiment of the foldable supporting device according to the present invention. The second preferred embodiment differs from the first preferred embodiment in that the track-defining walls 222 of the upper and lower parts 22 of each of the supporting frames 2 are dispensed with, that the frame beams 221 of the upper and lower parts 22 of each of the supporting frames 2 cooperatively define a respective one of the tracks 4, and that the post 331 of each of the second joints 33 has two opposite bifurcated ends 3312 engaging slidably and respectively the frame beams 221 of the upper and lower parts 22 of a respective one of the supporting frames 2. Each of the bifurcated ends 3312 of the post 331 of each of the second joints 33 defines a recess for extension of a respective one of the frame beams 221 of the upper and lower parts 22 therethrough.

In this embodiment, each two adjacent ones of the foldable assemblies are constructed in such a manner that the first joints 32 of the joint mechanism of the foldable unit 3 of one of the two adjacent ones of the foldable assemblies are pivoted respectively to the supporting frames 2 of the respective one of the two adjacent ones of the foldable assemblies, and are disposed respectively at the first sides of the supporting frames 2 of the respective one of the two adjacent ones of the foldable assemblies, that the second joints 33 of the joint mechanism of the foldable unit 3 of said one of the two adjacent ones of the foldable assemblies are disposed respectively adjacent to the second sides of the supporting frames 2 of the respective one of the two adjacent ones of the foldable assemblies when the foldable unit 3 of said one of the two adjacent ones of the foldable assemblies is disposed at the folded position (note that FIGS. 8 and 9 respectively illustrate the semi-folded position and the fully-folded position of the foldable supporting device, and that the alternate positions of the pair of the first joints 32 and the pair of the second joints 33 at the first and second sides of the supporting frames 2 of the foldable assembly are shown in FIGS. 7 and 8), that the first joints 32 of the joint mechanism of the foldable unit 3 of the other of the two adjacent ones of the foldable assemblies are pivoted respectively to the supporting frames 2 of the respective one of the two adjacent ones of the foldable assemblies, and are disposed respectively at the second sides of the supporting frames 2 of the respective one of the two adjacent ones of the foldable assemblies, and that the second joints 33 of the joint mechanism of the foldable unit 3 of the other of the two adjacent ones of the foldable assemblies are disposed respectively adjacent to the first sides of the supporting frames 2 of the respective one of the two adjacent ones of the foldable assemblies when the foldable unit 3 of the other of the two adjacent ones of the foldable assemblies is disposed at the folded position.

Figure 10:
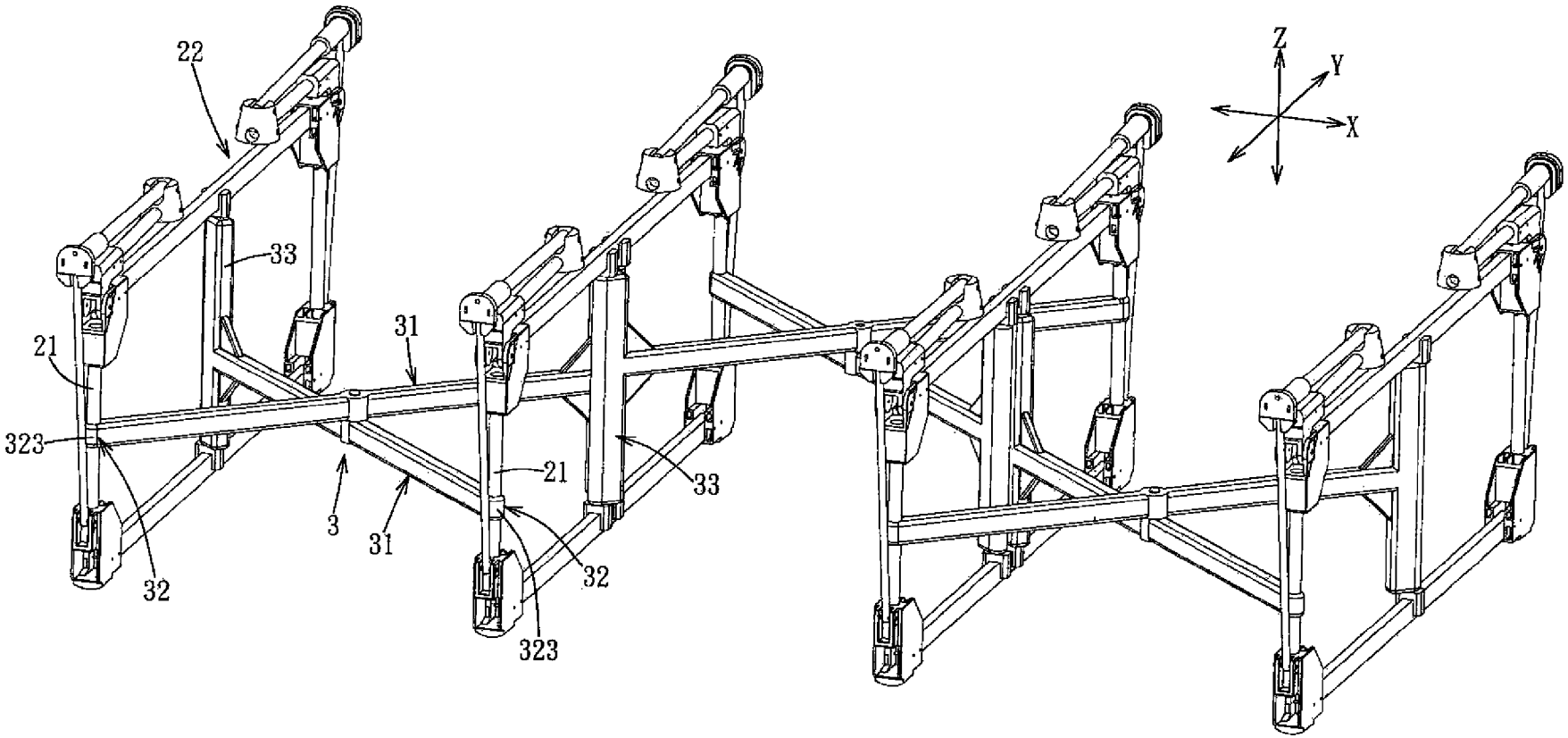
FIG. 10 is an assembled perspective view of the third preferred embodiment of a foldable supporting device according to the present invention, illustrating a state where the foldable units are disposed at fully-extended positions.
Figure 11:
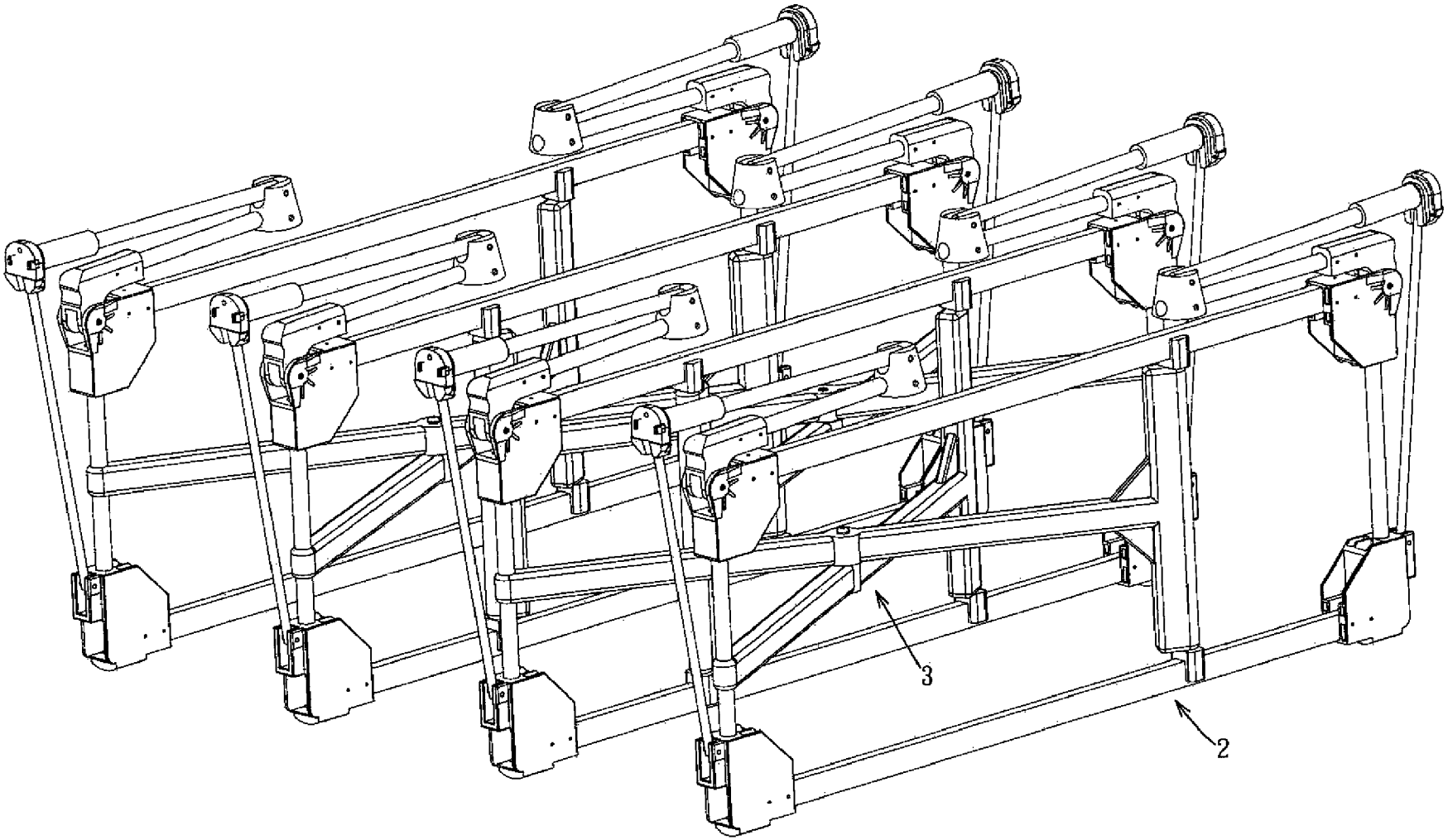
FIG. 11 is a perspective view of the third preferred embodiment, illustrating a state where the foldable units are disposed at semi-folded positions.
Figure 12:
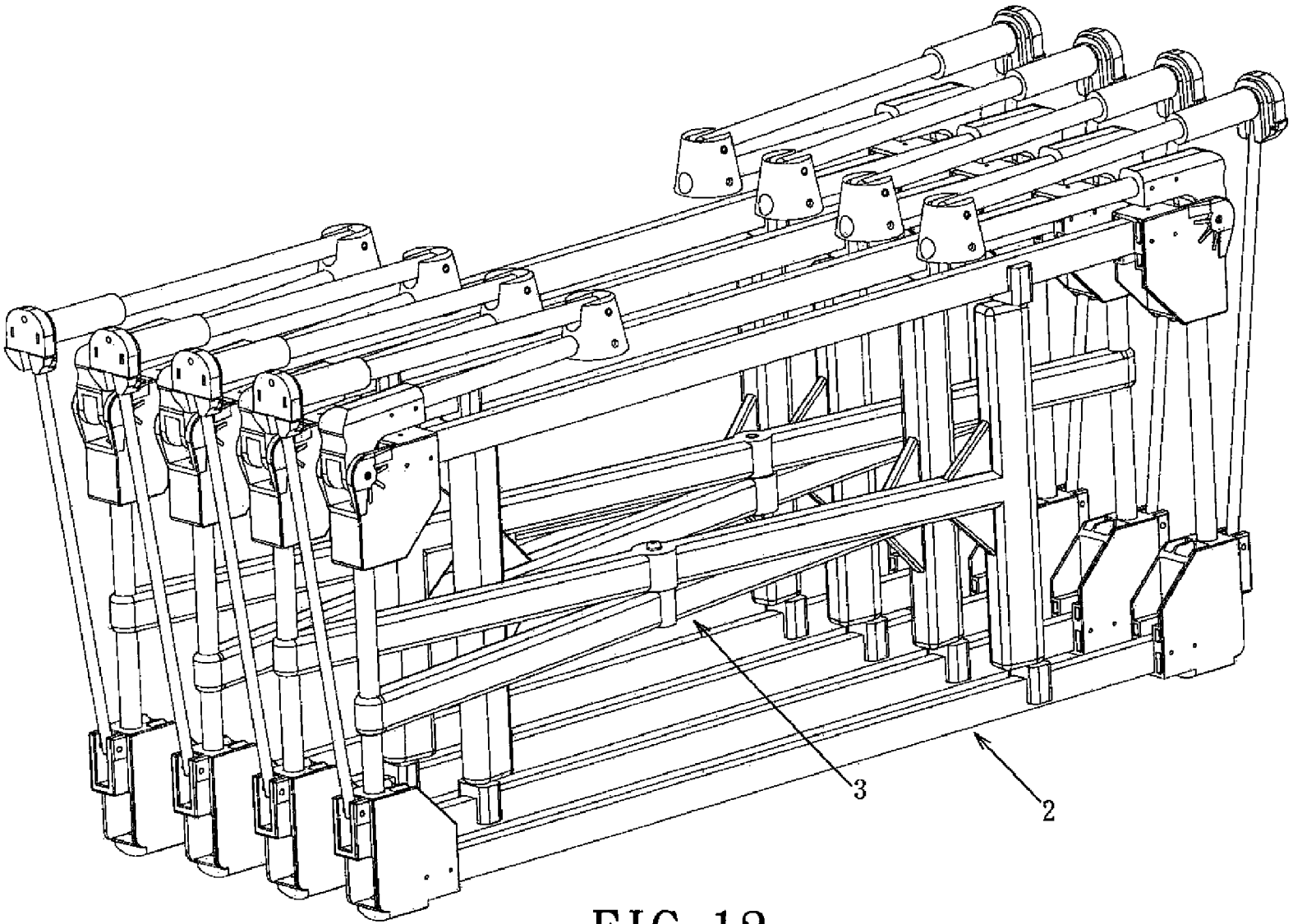
FIG. 12 is a perspective view of the third preferred embodiment, illustrating a state where the foldable units are disposed at folded positions.

FIGS. 10 to 12 illustrate the third preferred embodiment of the foldable supporting device according to the present invention, and show the fully-extended, semi-folded, and fully-folded positions of the foldable supporting device, respectively. The third preferred embodiment differs from the second preferred embodiment in that each of the first joints 32 is dispensed with the pole 321 and includes a sleeve 323 instead. The sleeves 323 of the first joints 32 are sleeved rotatably and respectively on an aligned pair of the first pillars 21 of the supporting frames 2 of the foldable assembly that are aligned in the first direction (X). Each of the crossing members 31 is connected to and is integrally formed with the sleeve 323 of a respective one of the first joints 32.

Figure 13:
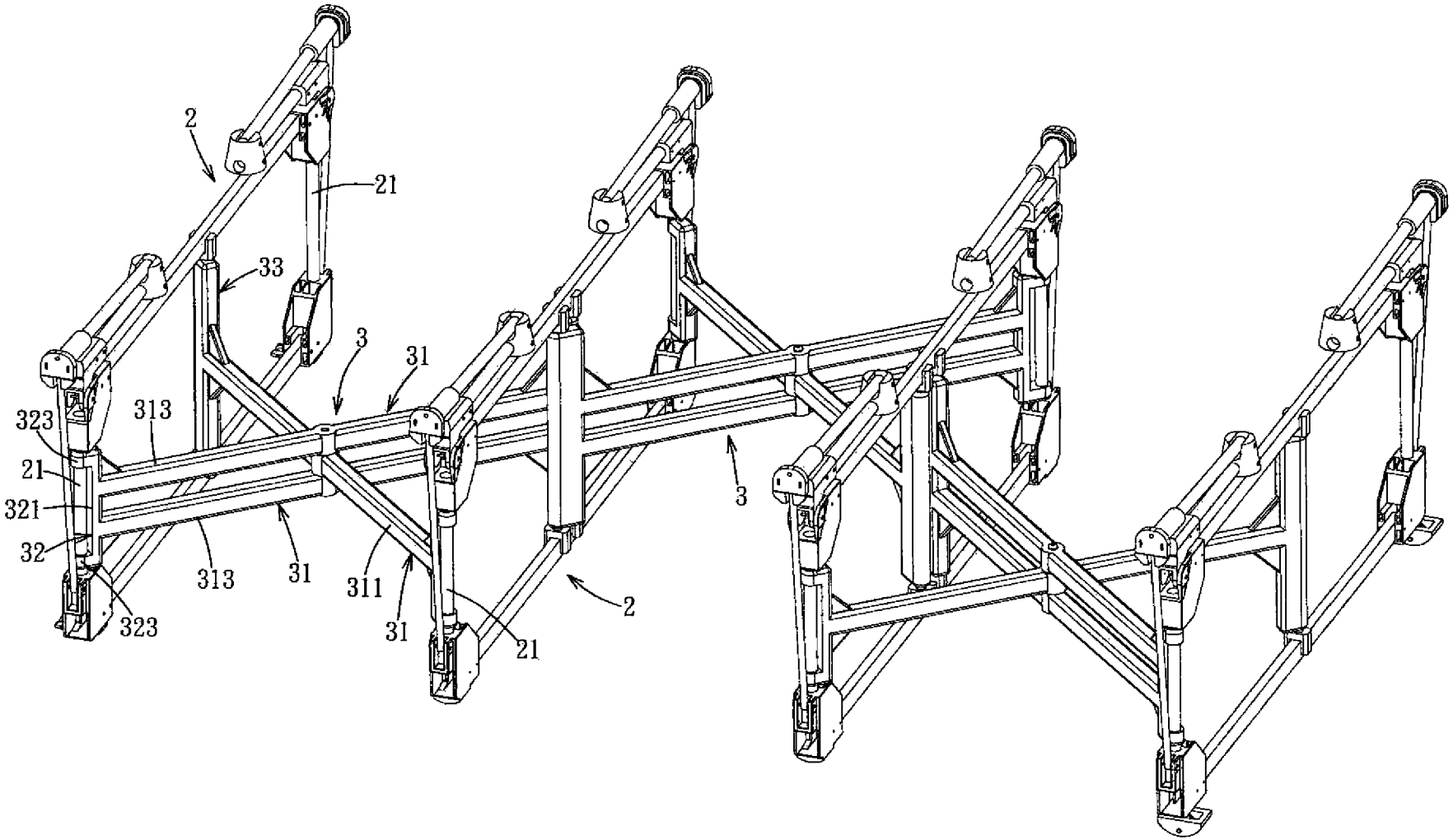
FIG. 13 is an assembled perspective view of the fourth preferred embodiment of a foldable supporting device according to the present invention, illustrating a state where the foldable units are disposed at fully-extended positions.

FIG. 13 illustrates the fourth preferred embodiment of the foldable supporting device according to the present invention. The fourth preferred embodiment differs from the third preferred embodiment in that one of the crossing members 31 includes a first crossbar 311 connected to the respective one of the two diagonally aligned pairs of the first and second joints 32, 33, and that the other of the crossing members 31 includes a pair of second crossbars 313 connected to the other of the two diagonally aligned pairs of the first and second joints 32, 33. The first crossbar 311 is disposed between, crosses, and is pivoted to the second crossbars 313. In addition, each of the first joints 32 includes a vertical bar 321 and upper and lower sleeves 323 extending respectively from upper and lower ends of the vertical bar 321 and sleeved on the first pillar 21 of a respective one of the supporting frames 2. The first crossbar 311 is connected to the vertical bar 321 of the respective one of the first joints 32. The second crossbars 313 are connected to the vertical bar 321 of the other of the first joints 32.

Figure 14:
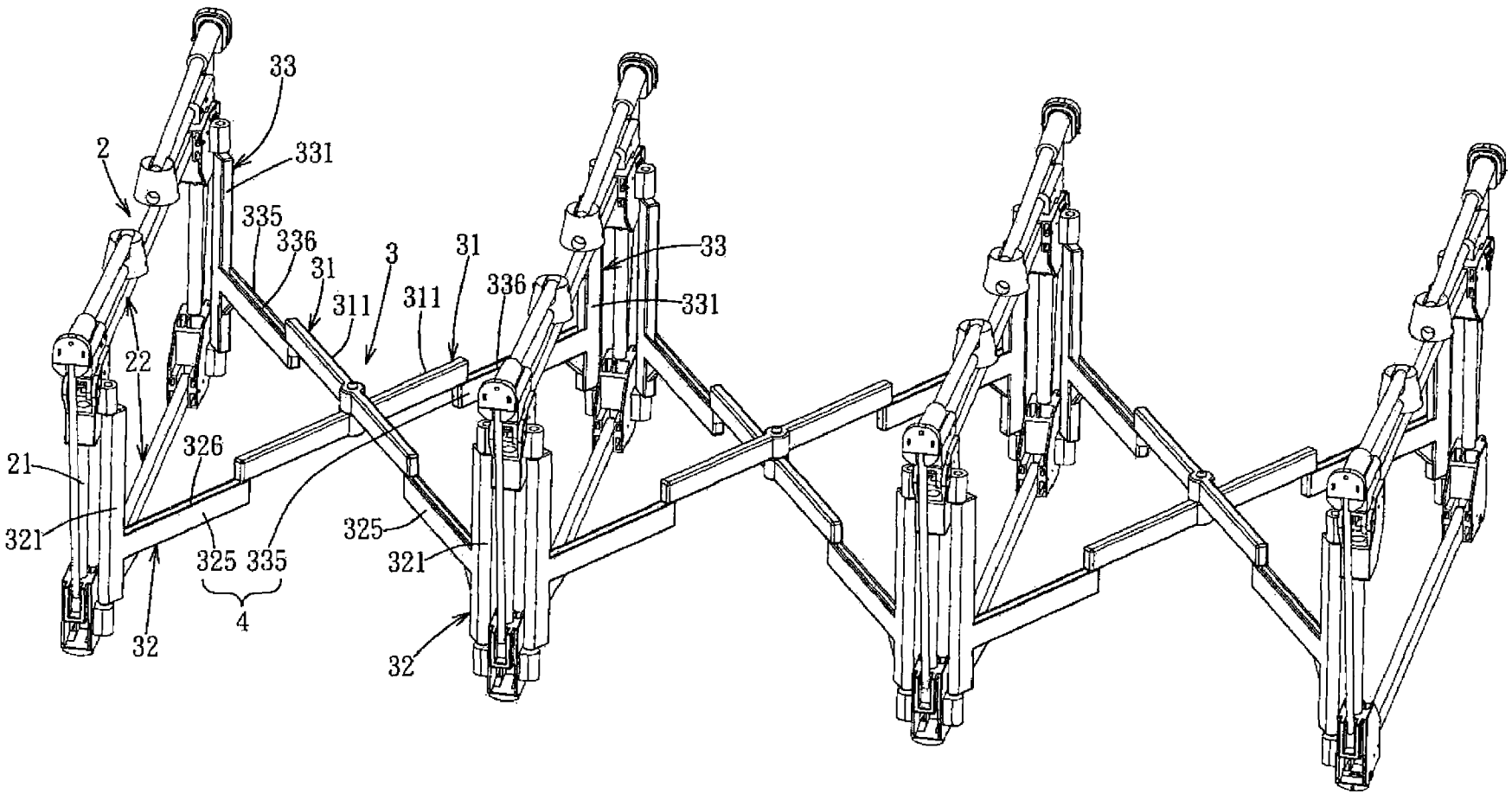
FIG. 14 is an assembled perspective view of the fifth preferred embodiment of a foldable supporting device according to the present invention, illustrating a state where the foldable units are disposed at fully-extended positions.
Figure 15:
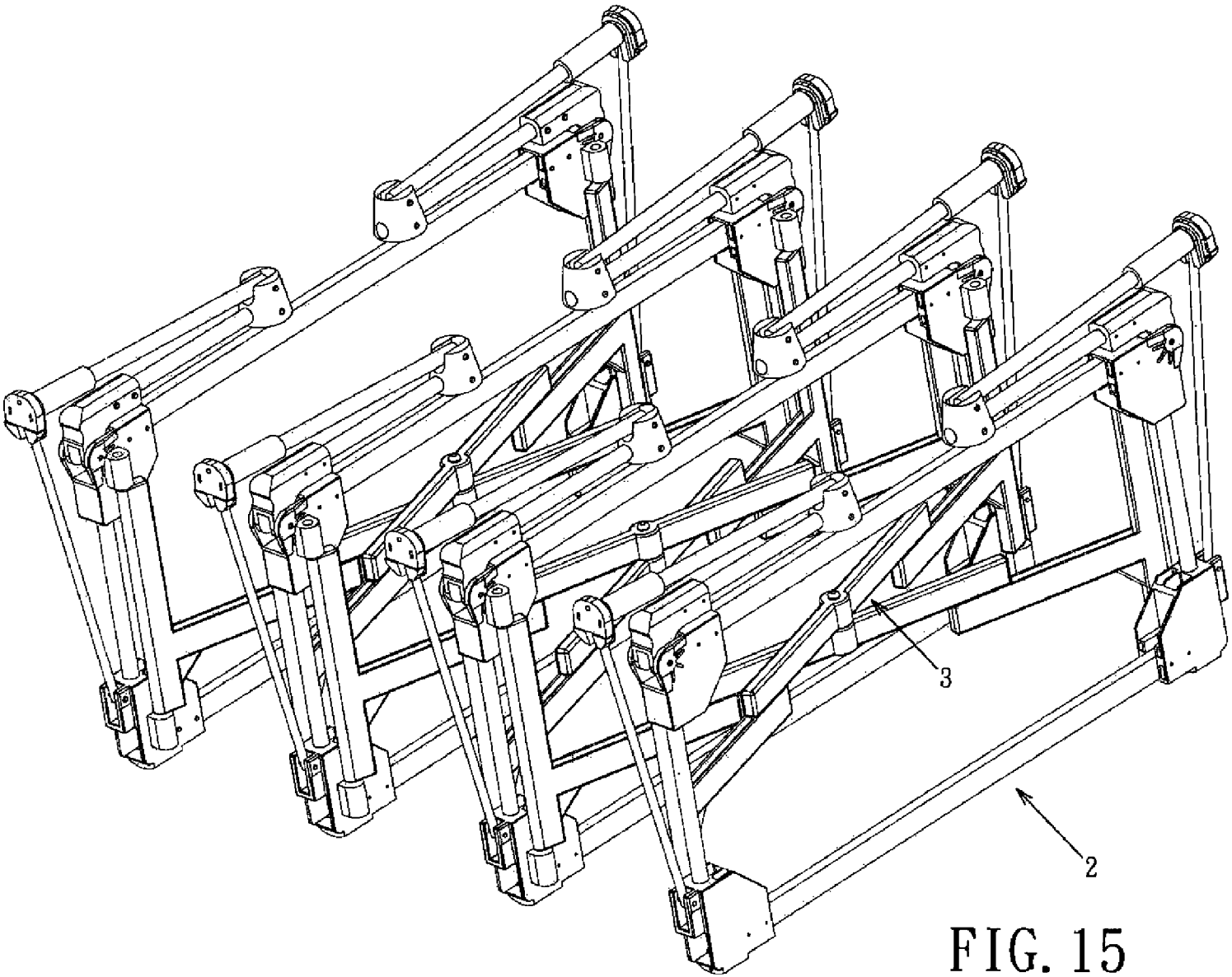
FIG. 15 is a perspective view of the fifth preferred embodiment, illustrating a state where the foldable units are disposed at semi-folded positions.
Figure 16:
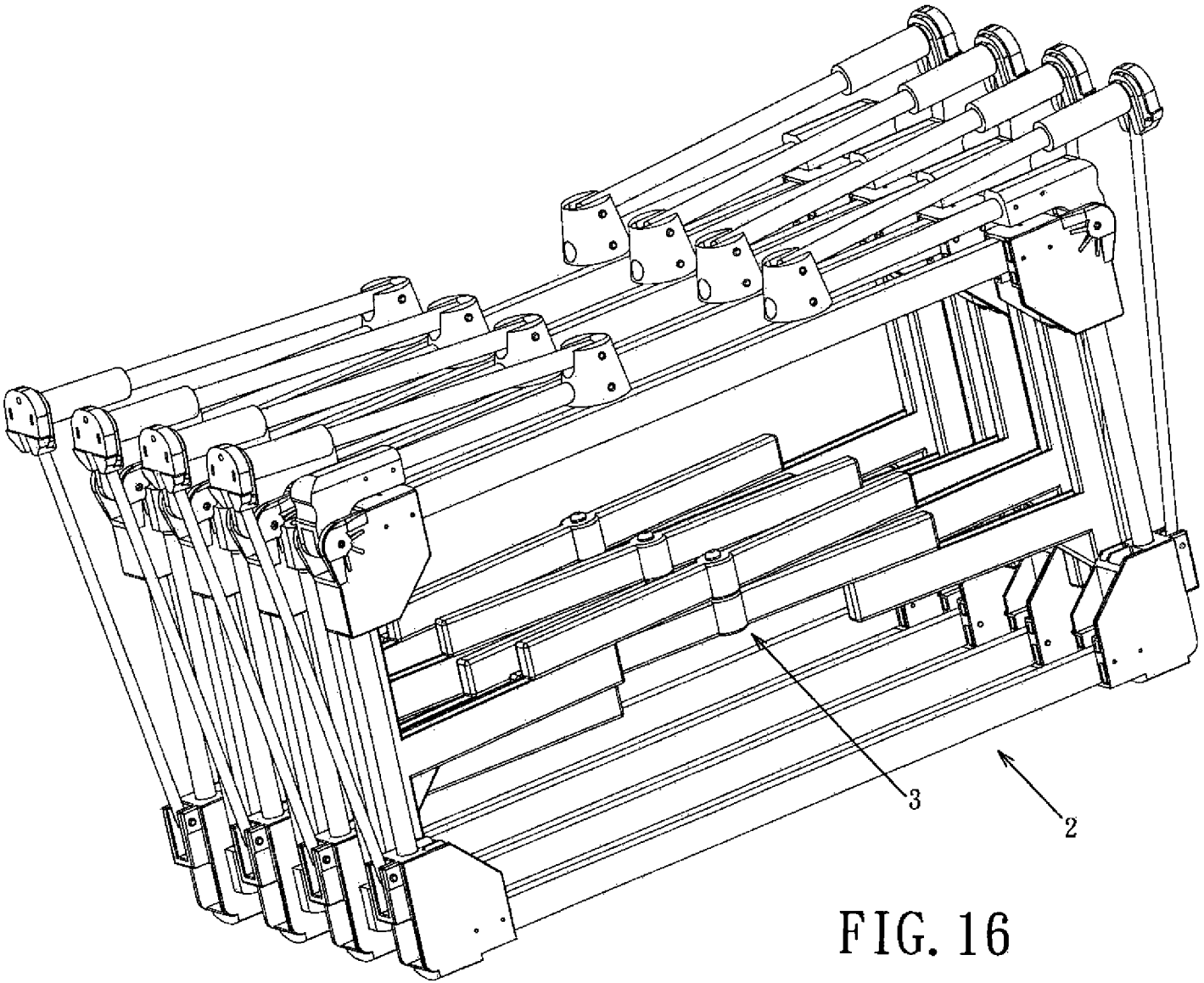
FIG. 16 is a perspective view of the fifth preferred embodiment, illustrating a state where the foldable units are disposed at folded positions.

FIGS. 14 to 16 illustrate the fifth preferred embodiment of the foldable supporting device according to the present invention, and show the fully-extended, semi-folded, and fully-folded positions of the foldable supporting device, respectively. The fifth preferred embodiment differs from the previous embodiment in that the pair of the first joints 32 and the pair of the second joints 33 define a pair of tracks 4 extending in the transverse direction, and that the crossing members 31 are slidable respectively on the tracks 4. In this embodiment, each of the first joints 32 cooperates with a diagonally aligned one of the second joints 33 to define a respective one of the tracks 4, and the first and second joints 32, 33 are pivoted to the supporting frames 2 of the foldable assembly. Each of the first and second joints 32, 33 includes a vertical bar 321, 331 extending between and pivoted to the upper and lower parts 22 of a respective one of the supporting frames 2 of the foldable assembly, and a horizontal bar 325, 335 transverse to and extending from the vertical bar 321, 331 and formed with a guiding groove 326, 336 extending in the transverse direction. The horizontal bar 325 of each of the first joints 32 cooperates with the horizontal bar 335 of a diagonally aligned one of the second joints 33 to define a respective one of the tracks 4. Each of the crossing members 31 includes a crossbar 311 having two opposite ends extending respectively into the guiding grooves 326, 336 in the horizontal bars 325, 335 of a diagonally aligned pair of the first and second joints 32, 33.

Figure 17:
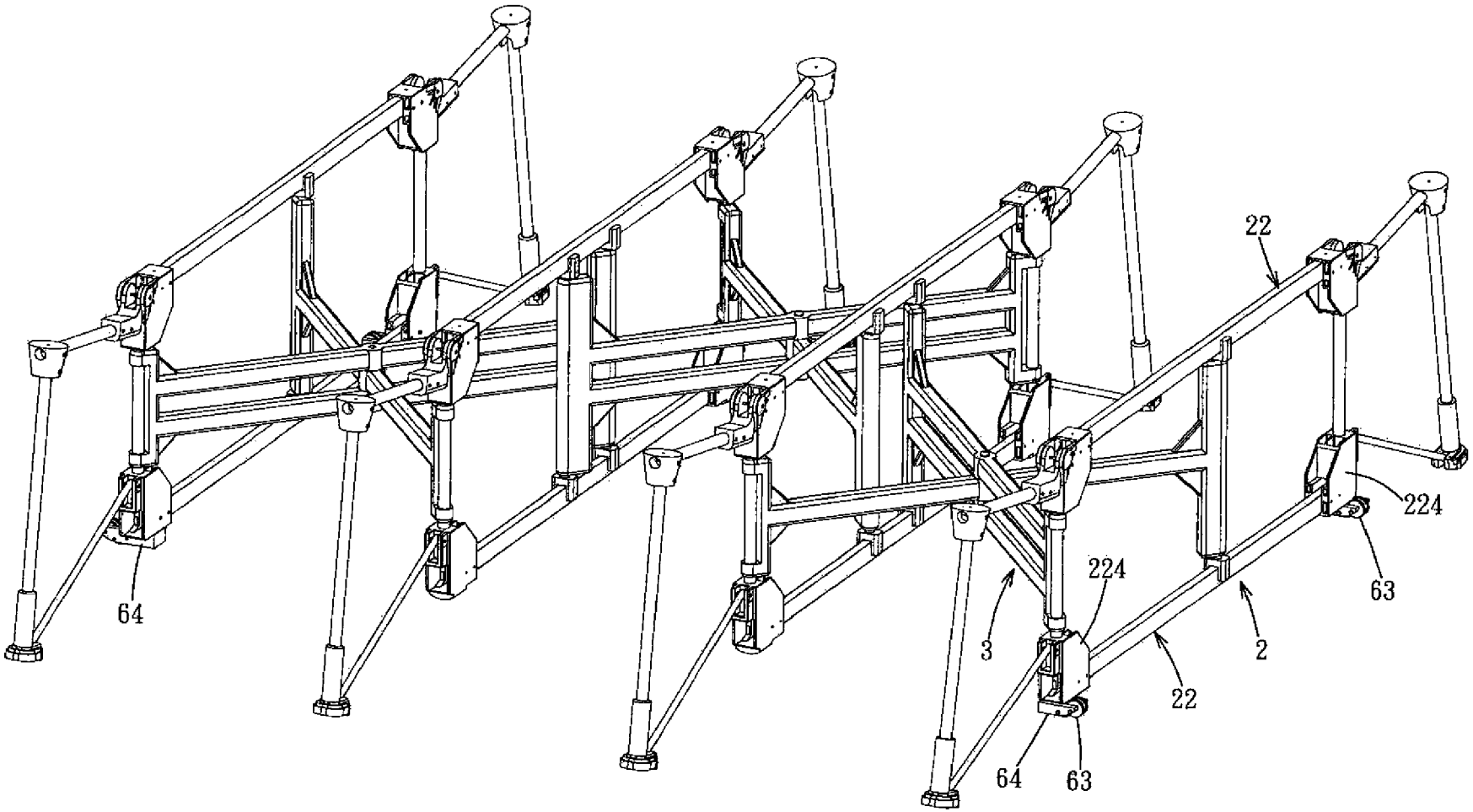
FIG. 17 is a perspective view of the sixth preferred embodiment of a foldable supporting device according to the present invention.
Figure 18:
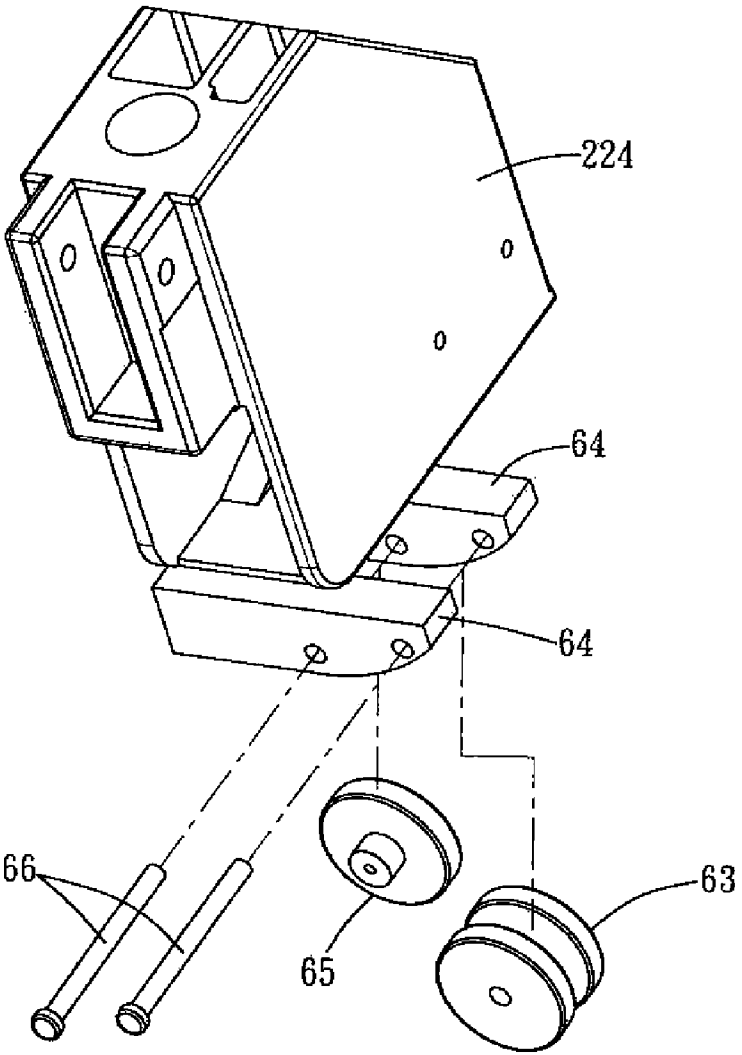
FIG. 18 is an exploded perspective view of a roller provided on a corner connector of the sixth preferred embodiment.

FIGS. 17 and 18 illustrate the sixth preferred embodiment of the foldable supporting device according to the present invention. The sixth preferred embodiment differs from the fourth embodiment in that each of the corner connectors 224 of the lower part 22 of each of the supporting frames 2 of the foldable assembly is provided with a pair of parallel mounting plates 64 that define a gap therebetween, and a pair of rollers 63, 65 extending into the gap and pivoted to the mounting plates 64 through a pair of parallel pivot pins 66.

Figure 20:
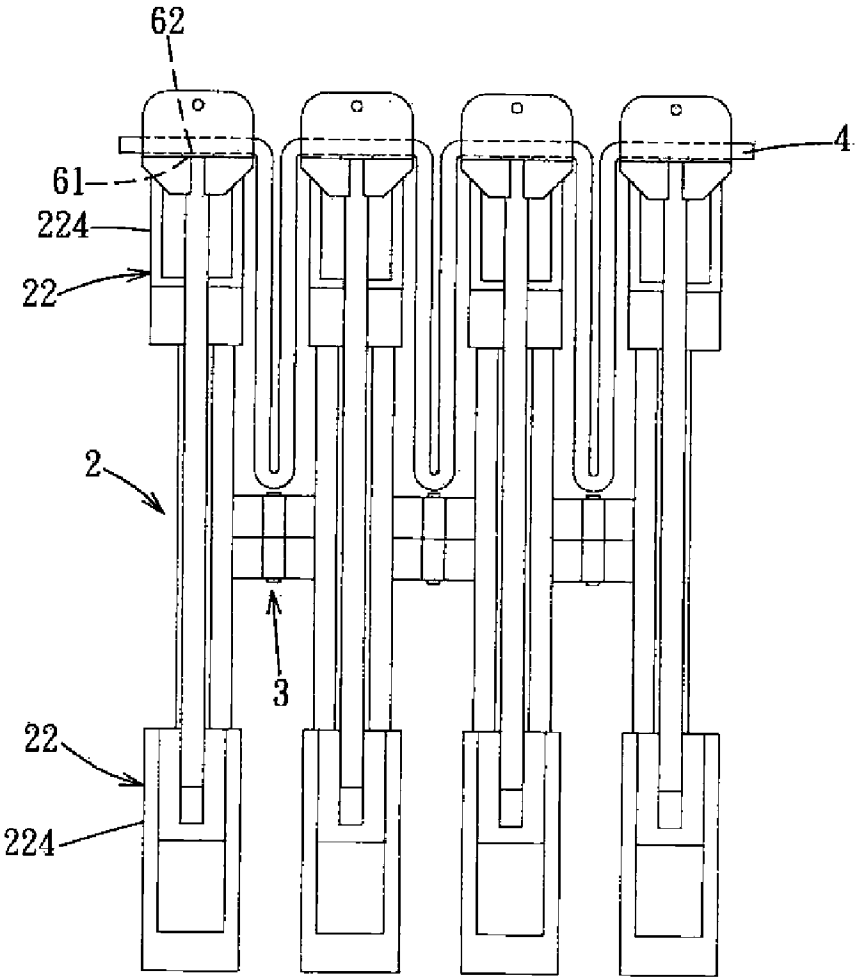
FIG. 20 is an enlarged view of a fastening unit of the seventh preferred embodiment.
Figure 19:
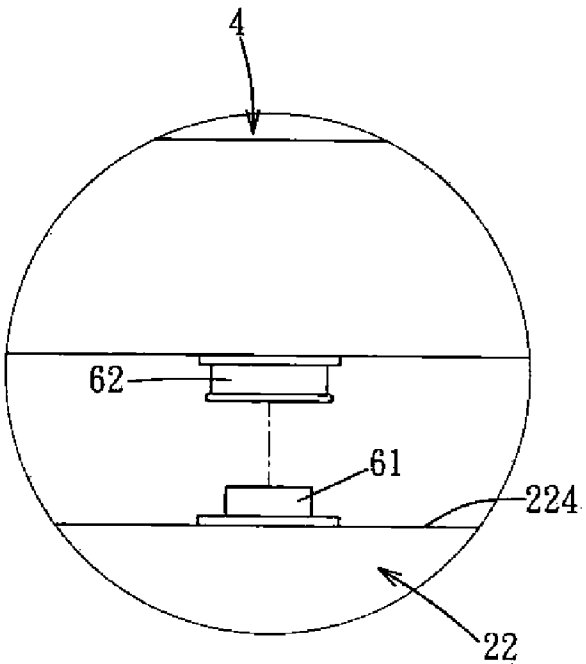
FIG. 19 is a schematic view of the seventh preferred embodiment of a foldable supporting device according to the present invention.

FIGS. 19 and 20 illustrate the seventh preferred embodiment of the foldable supporting device according to the present invention. The seventh preferred embodiment differs from the first preferred embodiment in that it further includes a fastening unit. The fastening unit includes a plurality of male button-fastening members 61, each of which is provided on a top end of a respective one the corner connectors 224 of the upper part 22 of a respective one of the supporting frames 2, and a plurality of female button-fastening members 62, each of which is adapted to be provided on the mattress 4 and each of which engages a respective one of the male button-fastening members 61.

Figure 21:
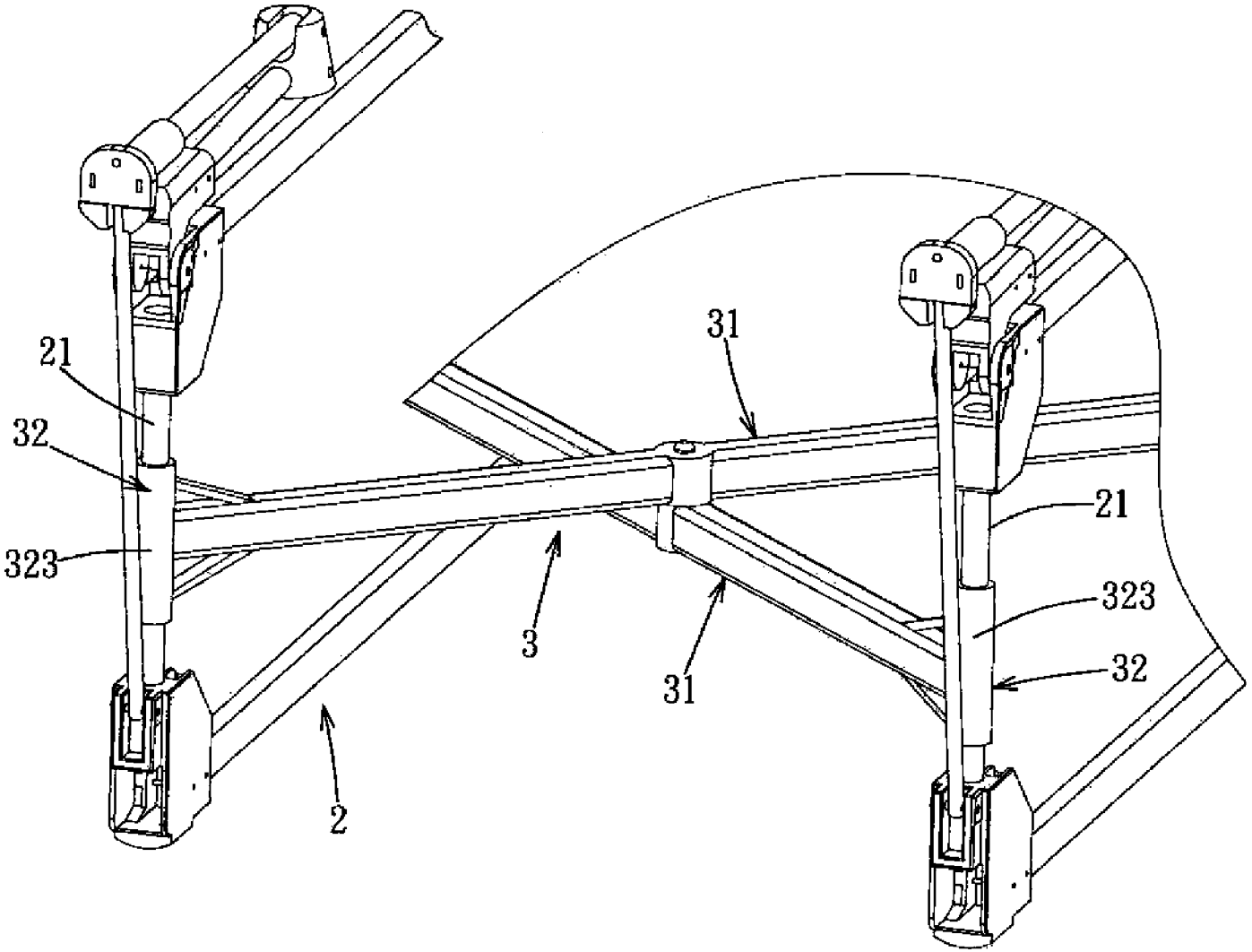
FIG. 21 is a fragmentary perspective view of the foldable supporting device modified from the third preferred embodiment.

FIG. 21 illustrates a modified foldable supporting device that is modified from the third preferred embodiment by increasing a vertical length of the sleeve 323 of each of the first joints 32.

With the inclusion of the crossing members 31 and the first and second joints 32, 33 in the foldable supporting device of this invention and with at least one of the pair of the first joints 32 and the pair of the second joints 33 interconnecting the upper and lower parts 22 of the adjacent pair of the supporting frames 2, the aforesaid drawback associated with the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A foldable supporting device comprising:

a plurality of parallel supporting frames that are aligned with each other in a first direction, each of said supporting frames including upper and lower parts that are opposite to each other in a vertical direction transverse to the first direction; and at least one foldable unit disposed between and interconnecting an adjacent pair of said supporting frames, and foldable in the first direction from an extended position to a folded position so as to vary the distance between said adjacent pair of said supporting frames;

wherein said foldable unit cooperates with said adjacent pair of said supporting frames to define a foldable assembly, said foldable unit including a pair of crossing members that cross each other so as to be rotatable relative to each other about a first axis, and a joint mechanism having a pair of first joints that are connected respectively to said adjacent pair of said supporting frames and that are aligned in the first direction, and a pair of second joints that are connected respectively to said adjacent pair of said supporting frames, that are aligned in the first direction, and that are respectively aligned with said first joints in a second direction transverse to the first direction, at least one of said pair of said first joints and said pair of said second joints being pivoted to said adjacent pair of said supporting frames so as to be respectively rotatable relative to said adjacent pair of said supporting frames about two second axes, each of said crossing members extending in a transverse direction relative to the vertical direction and interconnecting a respective one of two diagonally aligned pairs of said first and second joints;

wherein said pair of said first joints are pivoted respectively to said adjacent pair of said supporting frames so as to be respectively rotatable relative to said adjacent pair of said supporting frames about said second axes, said pair of said second joints being slidable on said adjacent pair of said supporting frames;

wherein each of said supporting frames has first and second sides that are opposite to each other in the second direction, and further includes first and second pillars that are disposed at said first and second sides, respectively, that extend in the vertical direction, and that have upper and lower ends, said upper and lower parts extending in the second direction and interconnecting said upper and lower ends of said first and second pillars;

wherein said adjacent pair of said supporting frames define a pair of tracks, said pair of said second joints being slidable on said tracks, said upper and lower parts of each of said supporting frames cooperatively defining a respective one of said tracks, said first joints being respectively pivoted to said supporting frames, each of said second joints including a post extending in the vertical direction, interconnecting slidably said upper and lower parts, and slidable on a respective one of said tracks, each of said crossing members being connected to said post of a respective one of said second joints; and wherein the height of each of said pillars of said supporting frames is kept unchangeable during the folding or extending operation of said foldable supporting device.

2. The foldable support device as claimed in claim 1, wherein each of said upper and lower parts of each of said supporting frames of said foldable assembly has a frame beam extending in the second direction, and a track-defining wall connected to said frame beam and formed with a rail groove parallel to said frame beam, said track-defining walls of said upper and lower parts of each of said supporting frames of said foldable assembly cooperatively defining a respective one of said tracks, said post of each of said second joints having two opposite end studs extending respectively into said rail grooves in said track-defining walls of said upper and lower parts of a respective one of said supporting frames of said foldable assembly.

3. The foldable supporting device as claimed in claim 2, wherein each of said upper and lower parts of each of said supporting frames of said foldable assembly further has a pair of corner connectors, said frame beams of said upper and lower parts interconnecting said first and second pillars through said corner connectors of said upper and lower parts, each of said first joints including a pole extending between and pivoted to a vertically aligned pair of said corner connectors of said upper and lower parts, each of said crossing members being connected to said pole of a respective one of said first joints.

4. The foldable supporting device as claimed in claim 3, wherein each of said corner connectors of said lower part of each of said supporting frames of said foldable assembly is provided with a roller.

5. The foldable support device as claimed in claim 1, wherein each of said upper and lower parts of each of said supporting frames of said foldable assembly has a frame beam extending in the second direction, said frame beams of said upper and lower parts of each of said supporting frames of said foldable assembly cooperatively defining a respective one of said tracks, said post of each of said second joints having two opposite bifurcated ends engaging slidably and respectively said frame beams of said upper and lower parts of a respective one of said supporting frames of said foldable assembly.

6. The foldable supporting device as claimed in claim 5, wherein each of said upper and lower parts of each of said supporting frames of said foldable assembly further has a pair of corner connectors, said frame beams of said upper and lower parts interconnecting said first and second pillars through said corner connectors of said upper and lower parts, each of said first joints including a pole extending between and pivoted to a vertically aligned pair of said corner connectors of said upper and lower parts, each of said crossing members being connected to said pole of a respective one of said first joints.

7. The foldable supporting device as claimed in claim 1, wherein each of said crossing members includes a crossbar connected to the respective one of said two diagonally aligned pairs of said first and second joints.

8. The foldable support device as claimed in claim 1, wherein one of said crossing members includes a first crossbar connected to the respective one of said two diagonally aligned pairs of said first and second joints, and the other of said crossing members includes a pair of second crossbars connected to the other of said two diagonally aligned pairs of said first and second joints, said first crossbar being disposed between, cross, and being pivoted to said second crossbars.

9. The foldable supporting device as claimed in claim 1, wherein said pair of said first joints and said pair of said second joints are pivoted to said adjacent pair of said supporting frames, and said crossing members are slidable on said pair of said first joints and said pair of said second joints.

10. The foldable supporting device as claimed in claim 9, wherein said pair of said first joints and said pair of said second joints define a pair of tracks extending in the transverse direction, said crossing member being slidable on said tracks, each of said first joints cooperating with a diagonally aligned one of said second joints to define a respective one of said tracks, said first and second joints being pivoted to said supporting frames of said foldable assembly, each of said first and second joints including a vertical bar extending between and pivoted to said upper and lower parts of a respective one of said supporting frames of said foldable assembly, and a horizontal bar transverse to and extending from said vertical bar and formed with a guiding groove extending in the transverse direction, said horizontal bar of each of said first joints cooperating with said horizontal bar of a diagonally aligned one of said second joints to define a respective one of said tracks, each of said crossing members including a crossbar having two opposite ends extending respectively into said guiding grooves in said horizontal bars of a diagonally aligned pair of said first and second joints.

11. The foldable supporting device as claimed in claim 1, wherein at least one of said pair of said first joints and said pair of said second joints interconnect said upper and lower parts of said adjacent pair of said supporting frames, respectively.

12. A foldable supporting device comprising:

a plurality of parallel supporting frames that are aligned with each other in a first direction, each of said supporting frames including upper and lower parts that are opposite to each other in a vertical direction transverse to the first direction; and at least one foldable unit disposed between and interconnecting an adjacent pair of said supporting frames, and foldable in the first direction from an extended position to a folded position so as to vary the distance between said adjacent pair of said supporting frames;

wherein said foldable unit cooperates with said adjacent pair of said supporting frames to define a foldable assembly, said foldable unit including a pair of crossing members that cross and that are pivoted to each other at an intersection thereof so as to be rotatable relative to each other about a first axis, and a joint mechanism having a pair of first joints that are connected respectively to said adjacent pair of said supporting frames and that are aligned in the first direction, and a pair of second joints that are connected respectively to said adjacent pair of said supporting frames, that are aligned in the first direction, and that are respectively aligned with said first joints in a second direction transverse to the first direction, at least one of said pair of said first joints and said pair of said second joints being pivoted to said adjacent pair of said supporting frames so as to be respectively rotatable relative to said adjacent pair of said supporting frames about two second axes, each of said crossing members extending in a transverse direction relative to the vertical direction and interconnecting a respective one of two diagonally aligned pairs of said first and second joints;

wherein said pair of said first joints are pivoted respectively to said adjacent pair of said supporting frames so as to be respectively rotatable relative to said adjacent pair of said supporting frames about said second axes, said pair of said second joints being slidable on said adjacent pair of said supporting frames;

wherein each of said supporting frames has first and second sides that are opposite to each other in the second direction, and further includes first and second pillars that are disposed at said first and second sides, respectively, that extend in the vertical direction, and that have upper and lower ends, said upper and lower parts extending in the second direction and interconnecting said upper and lower ends of said first and second pillars;

wherein said adjacent pair of said supporting frames define a pair of tracks, said pair of said second joints being slidable on said tracks, said upper and lower parts of each of said supporting frames cooperatively defining a respective one of said tracks, said first joints being respectively pivoted to said supporting frames, each of said second joints including a post extending in the vertical direction, interconnecting slidably said upper and lower parts, and slidable on a respective one of said tracks, each of said crossing members being connected to said post of a respective one of said second joints; and wherein each of said first joints includes a sleeve, said sleeves of said first joints being sleeved rotatably and respectively on an aligned pair of said first pillars of said supporting frames of said foldable assembly that are aligned in the first direction, each of said crossing members being connected to said sleeve of a respective one of said first joints.

* * * * *